US011053104B2

(12) United States Patent
Dunn et al.

(10) Patent No.: US 11,053,104 B2
(45) Date of Patent: Jul. 6, 2021

(54) BOOM FOR A PIPELAYING MACHINE

(71) Applicant: Caterpillar Inc., Deerfield, IL (US)

(72) Inventors: James Michael Dunn, Edwards, IL (US); Curtis J Caldwell, Metamora, IL (US); Sean D. Lawson, East Peoria, IL (US); Dana John Willer, Galva, IL (US)

(73) Assignee: Caterpillar Inc., Peoria, IL (US)

( * ) Notice: Subject to any disclaimer, the term of this patent is extended or adjusted under 35 U.S.C. 154(b) by 102 days.

(21) Appl. No.: 16/433,011

(22) Filed: Jun. 6, 2019

(65) Prior Publication Data

US 2020/0385246 A1 Dec. 10, 2020

(51) Int. Cl.
*B66C 23/64* (2006.01)
*B66C 23/44* (2006.01)

(52) U.S. Cl.
CPC ..... *B66C 23/64* (2013.01); *B66C 23/44* (2013.01)

(58) Field of Classification Search
CPC ..... B66C 23/44; B66C 23/64; B66C 23/66; B66C 23/70
See application file for complete search history.

(56) References Cited

U.S. PATENT DOCUMENTS 1,941,952 A * 1/1934 Nickles ..... B66C 23/70 212/177
2,322,697 A * 6/1943 Lawler ..... B66C 23/44 212/180
2,336,965 A * 12/1943 Shoemaker ..... B66C 23/36 212/299
2,413,529 A * 12/1946 Swaney ..... B66C 23/44 212/258
2,425,663 A * 8/1947 Wooldridge ..... B66C 23/44 212/288
3,028,697 A * 4/1962 Bator ..... B66C 23/36 172/438
3,058,600 A * 10/1962 Gosnell ..... B66C 23/44 212/203
3,564,789 A * 2/1971 Vyvyan ..... E04C 3/005 52/108

(Continued)

FOREIGN PATENT DOCUMENTS

CN 102322172 2/2013
CN 203889957 10/2014

(Continued)

*Primary Examiner* — Michael R Mansen
*Assistant Examiner* — Juan J Campos, Jr.

(57) ABSTRACT

A boom for a pipelaying machine includes a pair of posts located in a first plane and disposed in a tapered configuration with respect to a second plane transverse to the first plane. The boom also includes a cross-brace disposed between the pair of posts and located partway along a length of the pair of posts. The cross-brace includes a first link member and a second link member disposed along the first plane. Further, each of the first and second link members are angularly offset from each other and the second plane respectively. Furthermore, ends of the first and second link members are rigidly attached to the pair of posts. The cross-brace further includes a first rib member and a second rib member disposed along the second plane and rigidly attached to the first link member and the second link member respectively.

20 Claims, 4 Drawing Sheets

(56) References Cited

U.S. PATENT DOCUMENTS

| | | | | |
|---|---|---|---|---|
| 4,946,051 | A * | 8/1990 | Cliff | B66C 23/64 212/258 |
| 5,332,110 | A | 7/1994 | Forsyth | |
| 5,392,936 | A * | 2/1995 | Solomon | B66C 23/44 212/258 |
| 6,000,563 | A * | 12/1999 | Greenberg | B66C 23/44 212/258 |
| 7,823,347 | B1 * | 11/2010 | Blinn | E04C 3/08 52/244 |
| 7,896,178 | B2 | 3/2011 | Davis | |
| 2016/0362282 | A1 * | 12/2016 | Kataoka | B66C 23/62 |
| 2017/0057796 | A1 * | 3/2017 | Nakashima | B66C 23/64 |
| 2018/0065833 | A1 * | 3/2018 | Stoof | B66C 23/74 |
| 2018/0281877 | A1 * | 10/2018 | Piccinini | B66C 23/44 |
| 2019/0023538 | A1 * | 1/2019 | Pletz | B66C 23/42 |
| 2019/0031474 | A1 * | 1/2019 | Stilborn | B66C 13/16 |
| 2019/0033158 | A1 * | 1/2019 | Bonnet | G01L 5/0061 |
| 2019/0337776 | A1 * | 11/2019 | Fanello | B66C 23/44 |
| 2019/0352148 | A1 * | 11/2019 | Fanello | B66C 9/00 |

FOREIGN PATENT DOCUMENTS

| | | |
|---|---|---|
| CN | 105035978 | 11/2015 |
| RU | 2571312 | 12/2015 |
| RU | 2629998 | 9/2017 |

* cited by examiner

BOOM FOR A PIPELAYING MACHINE

TECHNICAL FIELD

The present disclosure relates to a pipelaying machine. More particularly, the present disclosure relates to a boom for a pipelaying machine.

BACKGROUND

A pipelaying machine may typically include a pivoting boom and a hoist mechanism associated with one end of the boom for co-operatively handling one or more pipe sections. Booms of traditional configurations for pipelaying machines may include a pair of posts that are typically subject to dynamically varying loads including, but not limited to, torsion that may manifest itself as bending forces on the posts. In many cases, these posts may be inadequately equipped to resist the torsional bending forces that are encountered during operation.

Although, in some cases, the posts may be additionally provided with reinforcement members, such reinforcement members may be sized and/or positioned such that the reinforcement members may obstruct the operator's view of the pipe and/or other areas adjacent to the machine in which one or more technicians may likely be present, for example, during a pipelaying operation. Further, due to a sizing of the reinforcement members, a weight of the reinforcement members may be less than optimal, and the reinforcement members may be rendered bulky. The bulkiness of the reinforcement members may add undesired weight to the reinforcement members and may consequently entail a greater load, from the additional undesired weight, to be moved by the hoist mechanism.

Hence, there is a need for a boom for a pipelaying machine that overcomes the aforementioned drawbacks.

SUMMARY OF THE DISCLOSURE

In an aspect of the present disclosure, a boom for a pipelaying machine includes a pair of posts that are located in a first plane and disposed in a tapered configuration with respect to a second plane transverse to the first plane. The boom also includes a cross-brace that is disposed between the pair of posts and located partway along a length of the pair of posts. The cross-brace includes a first link member and a second link member that are disposed along the first plane. Further, each of the first and second link members are angularly offset from each other and the second plane respectively. Furthermore, ends of each of the first and second link members are rigidly attached to the pair of posts. The cross-brace further includes a first rib member and a second rib member. Each of the first and second rib members are disposed along the second plane and rigidly attached to the first link member and the second link member respectively.

In another aspect of the present disclosure, a pipelaying machine includes a frame, an operator cab mounted on the frame, and a boom that is disposed adjacent to the operator cab and pivotally coupled to the frame. The boom includes a pair of posts are located in a first plane and pivotally coupled to the frame. Further, the pair of posts are disposed in a tapered configuration with respect to a second plane that is transverse to the first plane. The pipelaying machine further includes a cross-brace that is disposed between the pair of posts and located partway along a length of the pair of posts. The cross-brace includes a first link member and a second link member that are disposed along the first plane. Further, each of the first and second link members are angularly offset from each other and the second plane respectively. Furthermore, ends of each of the first and second link members are rigidly attached to the pair of posts. The cross-brace further includes a first rib member and a second rib member. Each of the first and second rib members are disposed along the second plane and rigidly attached to the first link member and the second link member respectively.

Other features and aspects of this disclosure will be apparent from the following description and the accompanying drawings.

DETAILED DESCRIPTION

Figure 1:
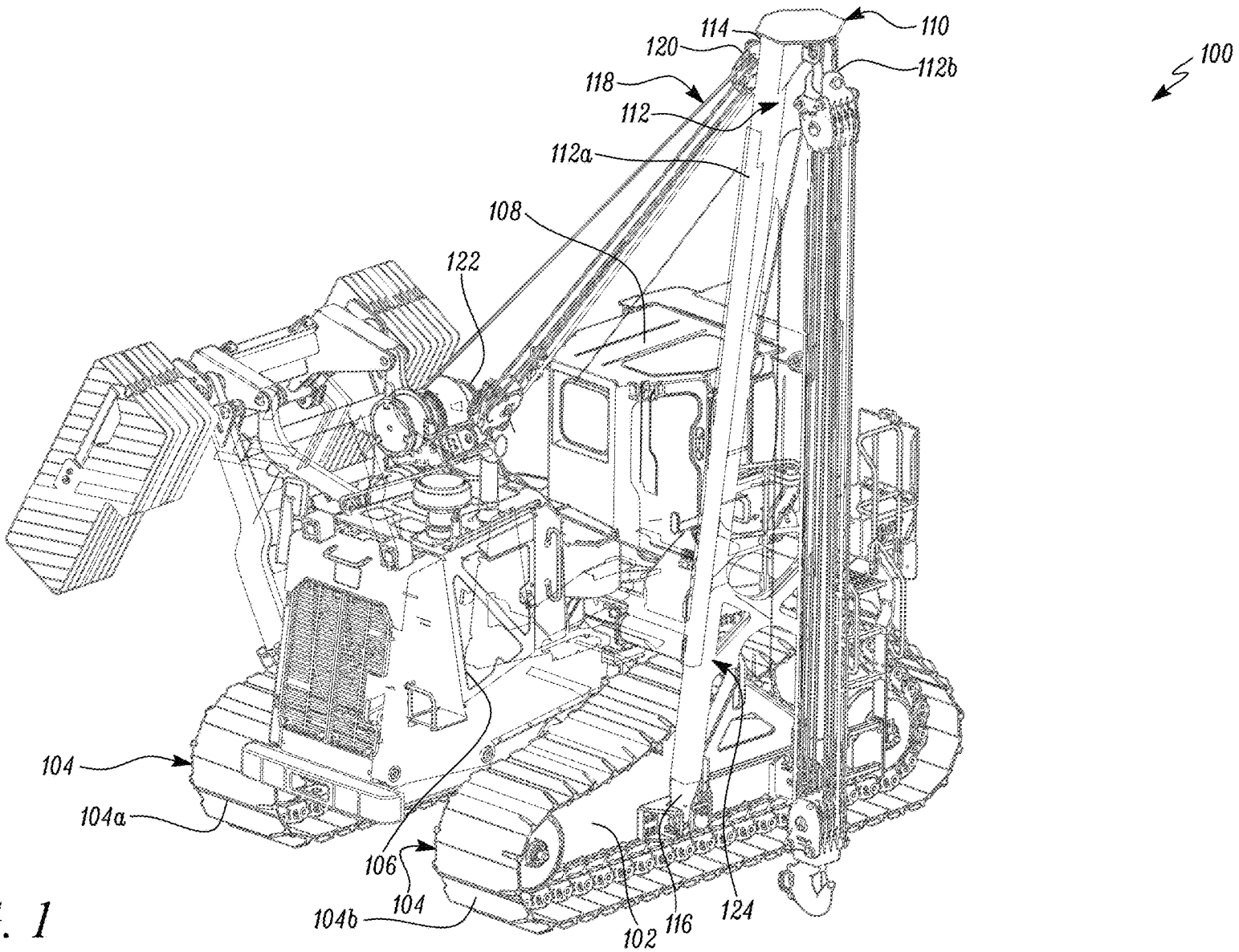
FIG. 1 is a side perspective view of a pipelaying machine showing a frame, an operator cab mounted on the frame, and a boom pivotally coupled to the frame according to an embodiment of the present disclosure.

Wherever possible, the same reference numbers will be used throughout the drawings to refer to the same or like parts. Referring to FIG. 1, a pipelaying machine 100 is illustrated in accordance with an embodiment of the present disclosure. For sake of simplicity and brevity of this disclosure, the pipelaying machine 100 will hereinafter be referred as "the machine 100.

As shown in the view of FIG. 1, the pipelaying machine 100 includes a frame 102 that is configured to rotatably support a pair of ground engaging members 104 for instance, a left crawler 104*a* and a right crawler 104*b*. Although the pair of crawlers 104*a*, 104*b* are disclosed, the pair of crawlers 104*a*, 104*b* are merely illustrative in nature and hence, non-limiting of this disclosure. In other embodiments, other types of ground engaging members, for example, wheels may be implemented in lieu of the crawlers 104*a*, 104*b* disclosed herein.

The machine 100 may include a prime mover 106 that is configured to independently and selectively rotate the pair of ground engaging members 104 for propelling the machine 100 on a work surface. In an embodiment, the prime mover 106 may include an internal combustion engine, for example, a gasoline-powered engine, a diesel-powered engine, or a natural gas engine. Although an internal combustion engine is disclosed herein, it should be noted that the internal combustion engine is merely illustrative in nature and hence, non-limiting of this disclosure. In alternative embodiments, other types of prime movers, for example, electric motors known to persons skilled in the art may be implemented for use in lieu of the internal combustion engine disclosed herein.

The machine 100 also includes an operator cab 108 mounted on the frame 102. The operator cab 108 may be configured to house one or more operator controls (not shown) therein, for example, a joystick, one or more levers, switches and/or buttons for allowing an operator to operatively control various components of the machine 100. The machine 100 further includes a boom 110 disposed adjacent to the operator cab 108 and pivotally coupled to the frame 102 of the machine 100. As shown, the boom 110 is disposed adjacent to the right crawler 104*b* of the pipelaying machine 100.

Figure 2:
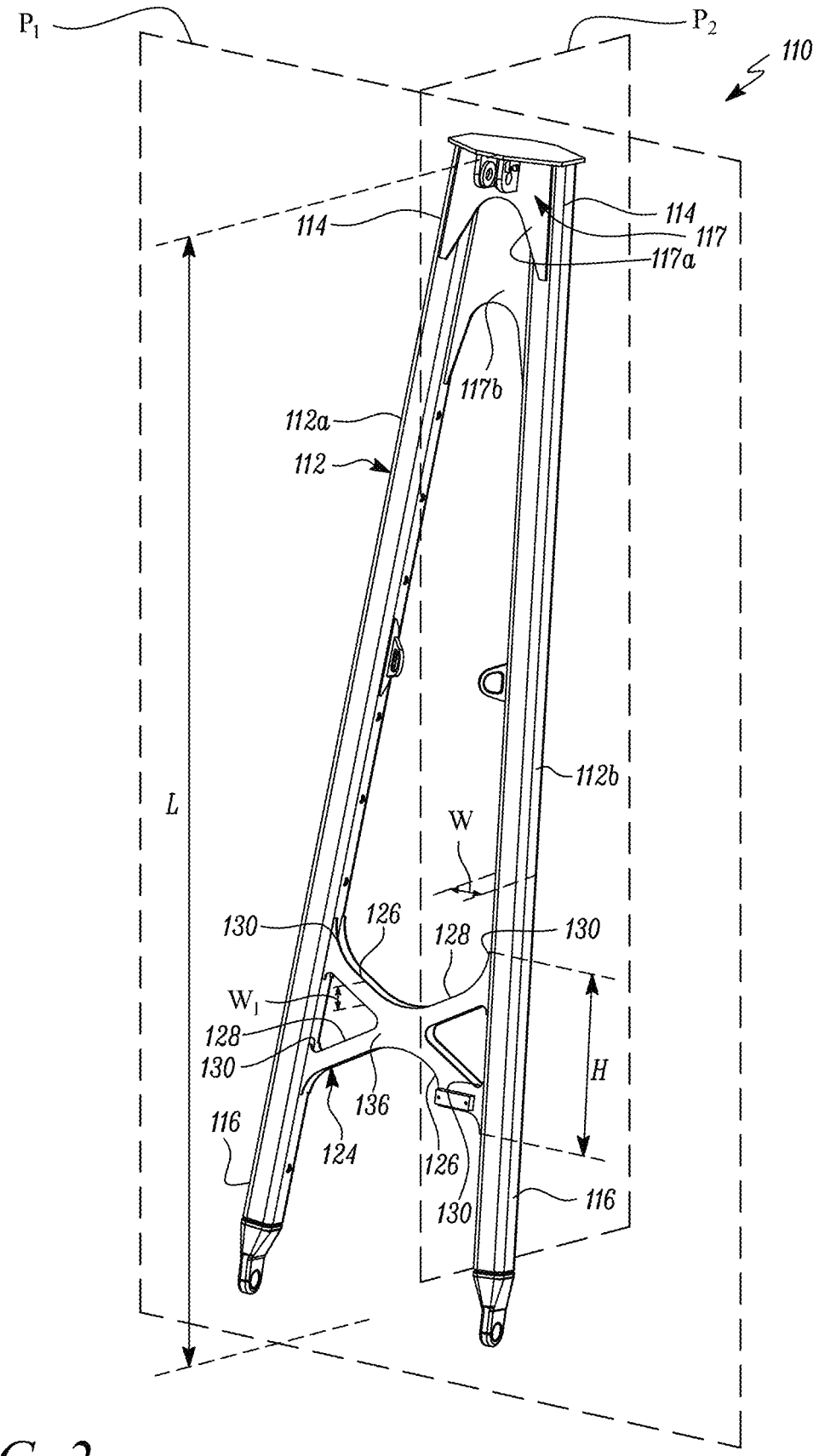
FIG. 2 is a front elevation view of the boom, according to an embodiment of the present disclosure.

Referring to FIGS. 1 and 2, the boom 110 includes a pair of posts 112 (individually denoted by alpha-numerals '112*a*' and '112*b*') that are located in a first plane $P_1$ and pivotally coupled to the frame 102. Further, the pair of posts 112*a*, 112*b* are disposed in a tapered configuration with respect to a second plane $P_2$ that is transverse to the first plane $P_1$. In an embodiment as shown in the view of FIG. 2, each post 112 is disposed in an angular relation to the second plane $P_2$ such that first distal ends 114 of respective ones of the posts 112*a*, 112*b* are proximate to each other and second distal ends 116 of respective ones of the posts 112*a*, 112*b* are spaced apart from each other. Further, the first distal ends 114 from respective ones of the posts 112*a*, 112*b* may be rigidly attached by at least one gusset 117, for example, a pair of gussets 117*a*, 117*b* as shown in the illustrated embodiment of FIG. 2.

In an embodiment, the machine 100 may further include a hoist mechanism 118, for example, a cable assisted hoist mechanism having a block and tackle assembly 120 that may be coupled to the boom 110 i.e., to the first distal ends 114 of the pair of posts 112*a*, 112*b* and operatively driven by a hoist motor 122, for example, an electric motor as shown in the view of FIG. 1. The hoist mechanism 118 is configured to operatively raise or lower the boom 110 relative to the frame 102 of the machine 100. Although a cable assisted hoist mechanism is disclosed herein, the cable assisted hoist mechanism is merely illustrative in nature and hence, non-limiting of this disclosure. In other embodiments, any type of hoist mechanism known to persons skilled in the art may be implemented in lieu of the cable assisted hoist mechanism disclosed herein.

With continued reference to FIGS. 1 and 2, the machine 100 further includes a cross-brace 124 that is disposed between the pair of posts 112*a*, 112*b* and located partway along a length of the pair of posts 112*a*, 112*b*. As shown best in the view of FIG. 2, the cross-brace 124 includes a first link member 126 and a second link member 128 that are disposed along the first plane $P_1$. Further, each of the first and second link members 126, 128 are angularly offset from each other and the second plane $P_2$ respectively. Furthermore, ends 130 of each of the first and second link members 126, 128 are rigidly attached to the pair of posts 112*a*, 112*b*. In an embodiment, ends 130 of each of the first and second link members 126, 128 may be attached to the pair of posts 112*a*, 112*b* by a plurality of welds (not shown).

In an embodiment, a maximum height 'H' of the cross-brace 124 may be less than 50% of the length 'L' associated with the pair of posts 112*a*, 112*b*. In a further embodiment, the maximum height 'H' of the cross-brace 124 may be less than 30% of the length 'L' associated with the pair of posts 112*a*, 112*b*, for example, less than 25% of the length 'L' associated with the pair of posts 112*a*, 112*b*.

Figure 3:
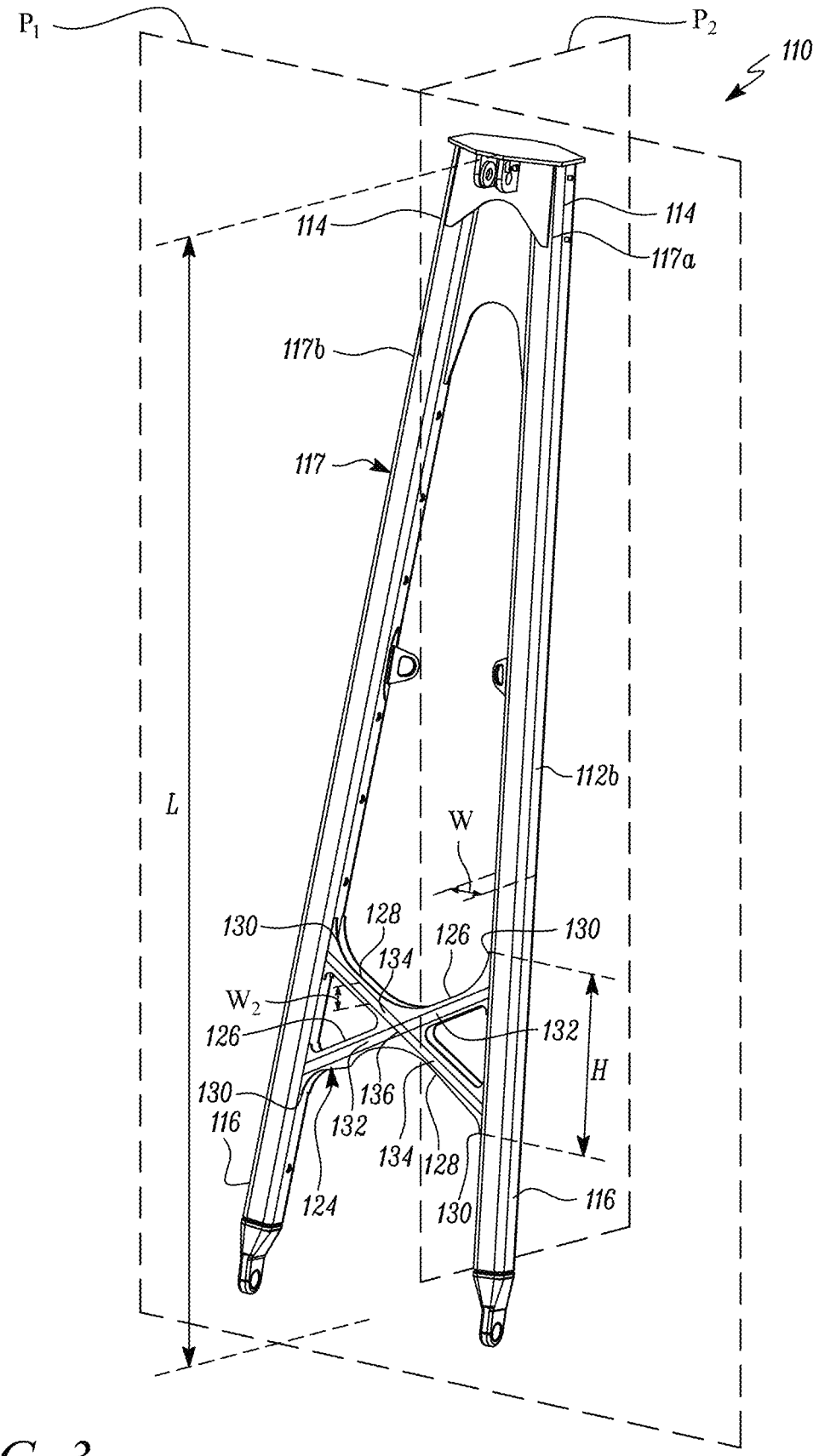
FIG. 3 is a rear elevation view of the boom, according to an embodiment of the present disclosure.

Referring to FIG. 3, the cross-brace 124 further includes a first rib member 132 and a second rib member 134. Each of the first and second rib members 132, 134 are disposed along the second plane $P_2$ and rigidly attached to the first link member 126 and the second link member 128 respectively. In an embodiment, the first rib member 132 and the second rib members 134 may be attached to the first link member 126 and the second link member 128 respectively by a plurality of welds (not shown).

In an embodiment as shown in the view of FIG. 2, the first link member 126 and the second link member 128 may be configured to intersect at a common mid-point 136. In an embodiment, this mid-point 136 may be located at less than 50% of the length 'L' associated with the pair of posts 112*a*, 112*b*. In a further embodiment, the mid-point 136 may be located at less than 30% of the length 'L' associated with the pair of posts 112*a*, 112*b*, for example, at 25% of the length 'L' associated with the pair of posts 112*a*, 112*b*.

Additionally, or optionally, in an embodiment as shown best in the view of FIG. 3, the first rib member 132 may be coterminous in length with the first link member 126 and the second rib member 134 may be coterminous in length with the second link member 128. Additionally, or optionally, in an embodiment as shown in the views of FIGS. 2 and 3, a width $W_1'$ of each of the first and second link members 126, 128 and a width $W_2'$ of each of the first and second rib members 132, 134 may be less than or equal to a width 'W' of any one post 112*a*/112*b* from the pair of posts 112.

Figure 4:
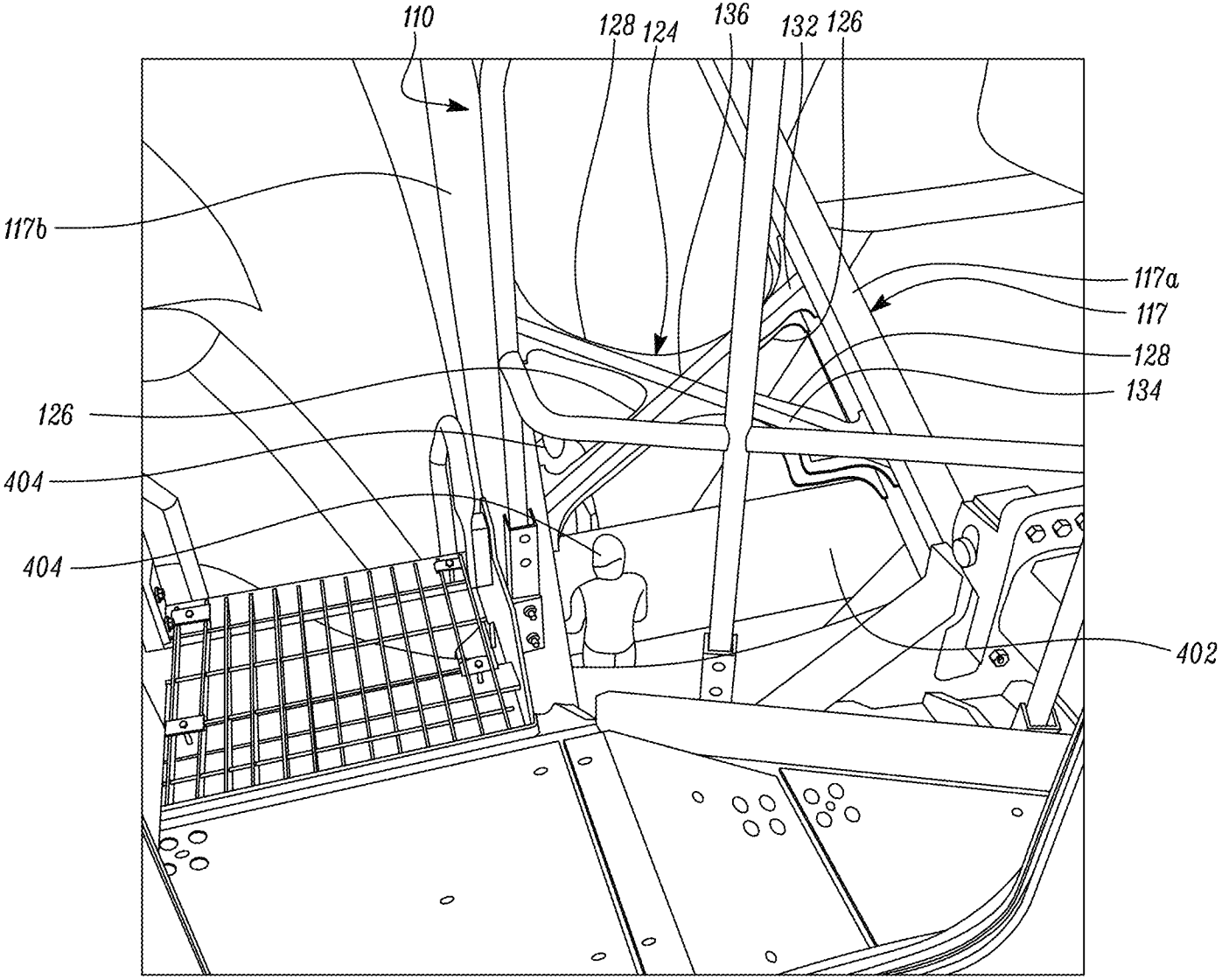
FIG. 4 is a rear perspective view of an exemplary area located in the vicinity of the boom as exemplarily seen from the operator cab of the pipelaying machine.

By way of the foregoing embodiments herein, it is hereby contemplated that due to the disclosed sizing and positioning of the cross-brace 124 in relation to the pair of posts 112*a*, 112*b*, the cross-brace 124 would be configured to provide maximum structural reinforcement to the pair of posts 112*a*, 112*b* against torsional loads, in at least the two mutually perpendicular planes $P_1$ and $P_2$, that may be encountered during a pipelaying operation while also causing the least amount of obstruction to an operator's view of a pipe 402 and/or other areas lying in the vicinity of the pipe 402 in which one or more technicians 404 are likely to be present, for example, during the pipelaying operation as shown in the exemplary view of FIG. 4. It may be noted that the obstruction to the operator's view of the pipe 402 and/or the technician/s 404 would be decreased to an extent that any hand signals used by the technician/s 404 to communicate with the operator would be visible to the operator at most, if not all, times i.e., through most part of the angular range of motion of the boom 110 about the second distal ends 116 of the pair of the posts 112*a*, 112*b* at which the boom 110 is pivotally coupled to the frame 102.

It is further contemplated that the sizing of the cross-brace 124 i.e., the first link member 126, the second link member 128, the first rib member 132 and the second rib member 134 would be selected such that the cross-brace 124 renders the boom 110 as lightweight as possible while imparting an enhancement in the structural integrity of the boom 110, or stated another way an improvement in the reliability and durability of the boom 110, for withstanding the torsional loads that are typically encountered in operation i.e., the pipelaying operation of the machine 100. It is also contemplated that the enhanced structural integrity of the boom 110 would facilitate use of the boom 110 for pipelaying operations over several cycles, for example, several hundred cycles, or several thousand cycles depending on specific criteria including, but not limited to, costs associated with manufacture of the boom 110 for the pipelaying machine 100 disclosed herein.

INDUSTRIAL APPLICABILITY

The present disclosure has applicability for use and implementation in providing a boom, with enhanced structural integrity i.e., with improved reliability and durability for withstanding torsional loads, for use on pipelaying machines. Owing to its reduced mass, the lightweight yet sturdy boom 110 of the present disclosure is also configured to reduce an operational load of the hoist mechanism 118 present on the machine 100 when the hoist mechanism 118 operatively raises or lowers the boom 110 relative to the frame 102 of the machine 100. Consequently, a size, peak load handling capacity and/or costs of the hoist mechanism 118 may be reduced to save equipment and/or operational costs.

Further, due to the disclosed sizing and/or positioning of the cross-brace 124 that is used to reinforce the pair of posts 112*a*, 112*b*, the cross-brace 124 is configured to allow the technician/s 404 to issue one or more hand signals for allowing the operator of the machine 100 to visually confirm such hand signals and accordingly operate the machine 100, and in particular, the boom 110 of the machine 100. Consequently, operators can perform the pipelaying operation conveniently and effectively with little or no hassle in the movement of the pipe 402 to a desired location. This way, the boom 110 of the present disclosure helps reduce operator fatigue while improving a productivity of the machine 100 by improving an efficiency with which the pipelaying operation may be carried out. Furthermore, the boom 110 of the present disclosure also helps the operator of the machine 100 to now command movement of the machine 100 and the boom 110, in particular, under improved visibility via hand signals issued by the technician/s 404 via the cross-brace 124 of the boom 110.

All directional references (e.g., left, right) are only used for identification purposes to aid the reader's understanding of the present disclosure, and may not create limitations, particularly as to the position, orientation, or use of the components disclosed herein. Joinder references (e.g., affixed attached, coupled, connected, associated and the like) are to be construed broadly and may include intermediate members between a connection of components. As such, joiner references do not necessarily infer that two segments are directly connected and in fixed relation to each other.

Additionally, all numerical terms, such as, but not limited to, "first", "second", "third", or any other ordinary and/or numerical terms, should also be taken only as identifiers, to assist the reader's understanding of the various embodiments, variations and/or modifications of the present disclosure, and may not create any limitations, particularly as to the order, or preference, of any component relative to, or over, another component.

While aspects of the present disclosure have been particularly shown and described with reference to the embodiments above, it will be understood by those skilled in the art that various additional embodiments may be contemplated by the modification of the disclosed machine 100 or the boom 110 without departing from the spirit and scope of the disclosure. Such embodiments should be understood to fall within the scope of the present disclosure as determined based upon the claims and any equivalents thereof

What is claimed is:

1. A boom for a pipelaying machine, the boom having a base end adapted to be pivotally coupled to the pipelaying machine and a distal end opposite the base end, and the boom comprising:

a pair of posts located in a first plane and disposed in a tapered configuration with respect to a second plane transverse to the first plane; and a cross-brace disposed between the pair of posts and located partway along a length of the pair of posts, the cross-brace comprising:

a first link member and a second link member disposed along the first plane, wherein each of the first link member and the second link member are angularly offset from each other and the second plane respectively, and wherein ends of each of the first and second link members are rigidly attached to the pair of posts; and a first rib member and a second rib member disposed along the second plane and rigidly attached to the first link member and the second link member respective, wherein both of the ends of the first and second link members are closer to the base end of the boom than the distal end of the boom and a maximum height of the cross-brace in a length direction of the boom is less than a maximum width of the cross-brace in a width direction of the boom perpendicular to the length direction, such that a first window between the cross-brace and the distal end of the boom is greater in area than a second window between the cross-brace and the base end of the boom.

2. The boom of claim 1, wherein the first link member and the second link member are configured to intersect at a common mid-point.

3. The boom of claim 2, wherein the common mid-point is located at less than 50% of the length associated with the pair of posts.

4. The boom of claim 3, wherein the common mid-point is located at less than 30% of the length associated with the pair of posts.

5. The boom of claim 1, wherein the maximum height of the cross-brace is less than 50% of the length associated with the pair of posts.

6. The boom of claim 5, wherein the maximum height of the cross-brace is less than 30% of the length associated with the pair of posts.

7. The boom of claim 1, wherein a width of each of the first and second link members and a width of each of the first and second rib members is less than or equal to a width of one post from the pair of posts.

8. The boom of claim 1, wherein the first rib member is coterminous in length with the first link member and the second rib member is coterminous in length with the second link member.

9. The boom of claim 1, wherein each post is disposed in an angular relation to the second plane such that first distal ends of respective ones of the posts are proximate to each other and second distal ends of respective ones of the posts are spaced apart from each other.

10. The boom of claim 9, wherein the first distal ends of respective ones of the posts are rigidly attached by at least one gusset.

11. A pipelaying machine comprising:

a frame;

an operator cab mounted on the frame;

a boom disposed adjacent to the operator cab and pivotally coupled to the frame, the boom comprising:

a pair of posts located in a first plane and pivotally coupled to the frame, the pair of posts disposed in a tapered configuration with respect to a second plane transverse to the first plane; and a cross-brace disposed between the pair of posts and located partway along a length of the pair of posts, the cross-brace comprising:

a first link member and a second link member disposed along the first plane, wherein each of the first link member and the second link member are angularly offset from each other and the second plane respectively, and wherein ends of each of the first and second link members are rigidly attached to the pair of posts; and a first rib member and a second rib member disposed along the second plane and rigidly attached to the first link member and the second link member respectively, wherein both of the ends of the first and second link members are closer to a base end of the boom than a distal end of the boom and a maximum height of the cross-brace in a length direction of the boom is less than a maximum width of the cross-brace in a width direction of the boom perpendicular to the length direction.

12. The pipelaying machine of claim 11, wherein the first link member and the second link member are configured to intersect at a common mid-point, and wherein the first rib member and the second rib member are configured to intersect at the common mid-point.

13. The pipelaying machine of claim 12, wherein the common mid-point is located at less than 50% of the length associated with the pair of posts.

14. The pipelaying machine of claim 13, wherein the common mid-point is located at less than 30% of the length associated with the pair of posts.

15. The pipelaying machine of claim 11, wherein the maximum height of the cross-brace is less than 50% of the length associated with the pair of posts.

16. The pipelaying machine of claim 15, wherein the maximum height of the cross-brace is less than 30% of the length associated with the pair of posts.

17. The pipelaying machine of claim 11, wherein a width of each of the first and second link members and a width of each of the first and second rib members is less than or equal to a width of one post from the pair of posts.

18. The pipelaying machine of claim 11, wherein the first rib member is coterminous in length with the first link member and the second rib member is coterminous in length with the second link member.

19. The pipelaying machine of claim 11, wherein each post is disposed in an angular relation to the second plane such that first distal ends of respective ones of the posts are proximate to each other and second distal ends of respective ones of the posts are spaced apart from each other.

20. The pipelaying machine of claim 19, wherein a pair of symmetrical windows formed between the first link member and the second link member and the pair of posts defines a total area less than each of a first total area of a first window between the cross-brace and the distal end of the boom and a second total area of a second window between the cross-brace and the base end of the boom.

* * * * *